United States Patent [19]

Fujita et al.

[11] 4,446,643

[45] May 8, 1984

[54] MOVABLE LARGE DISPLAY DEVICE

[75] Inventors: Shozo Fujita; Shunichi Futatsuishi; Takashi Takushima, all of Nagasaki, Japan

[73] Assignee: Mitsubishi Denki Kabushiki Kaisha, Tokyo, Japan

[21] Appl. No.: 399,585

[22] Filed: Jul. 19, 1982

[30] Foreign Application Priority Data

Jul. 20, 1981 [JP] Japan ..... 56-108453

[51] Int. Cl.[3] ..... G09F 21/04

[52] U.S. Cl. ..... 40/590; 40/591

[58] Field of Search ..... 40/541, 590, 591, 592, 40/593, 463; 361/383, 384; 340/717, 792, 809

[56] References Cited

U.S. PATENT DOCUMENTS

| | | | |
|---|---|---|---|
| 3,384,888 | 5/1968 | Harnden, Jr. et al. | 340/792 |
| 3,431,554 | 3/1969 | Barbie et al. | 40/463 |
| 3,432,846 | 3/1969 | Jones et al. | 40/463 |
| 3,538,633 | 11/1970 | Elliott, Jr. | 40/590 |
| 4,110,792 | 8/1978 | Long et al. | 358/240 |
| 4,148,534 | 4/1979 | Veburg | 361/384 |
| 4,352,274 | 10/1982 | Anderson et al. | 361/384 |
| 4,364,444 | 12/1982 | Donato et al. | 361/384 |

*Primary Examiner*—Gene Mancene
*Assistant Examiner*—Kris R. Schulze
*Attorney, Agent, or Firm*—Sughrue, Mion, Zinn, Macpeak, and Seas

[57] ABSTRACT

A large sized display device including a number of heat generating display elements such as lights, etc. is provided internally with a cooling mechanism which prevents external moisture, etc. from creating problems in the internal equipment.

3 Claims, 2 Drawing Figures

MOVABLE LARGE DISPLAY DEVICE

BACKGROUND OF THE INVENTION

This invention relates to a movable large display device for displaying characters and images, and more particularly, to a display device wherein the internal air is circulated by air conditioners provided inside of the display device body, to thereby cool the heat generating elements of a light emitting section which is adapted to display characters and images, and to protect the internal equipment from problems which might otherwise be caused by the external air including dust and moisture.

Portable display devices of large size are known in the art, as for example in U.S. Pat. No. 4,110,792 to Long. However, this device is removed in both design and character from that of the invention.

DETAILED DESCRIPTION OF THE PREFERRED EMBODIMENTS

Figure 2:
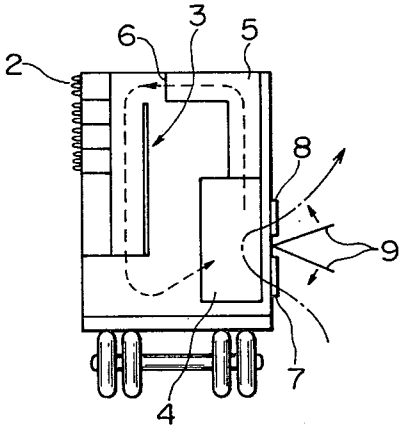
FIG. 2 is a sectional side view of the display device shown in FIG. 1.
Figure 1:
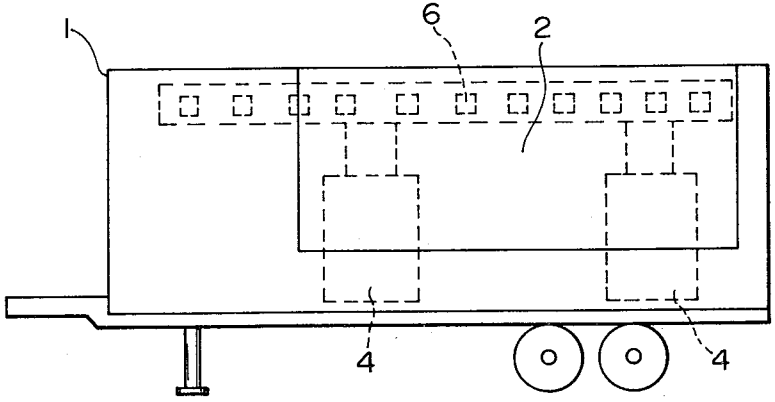
FIG. 1 is a front view outlining a movable large display device according to one emodiment of this invention.

One embodiment of the invention will now be described. With reference to FIGS. 1 and 2, reference numeral 1 designates a display device body which is moved by a trailer. A light emitting display section 2 is disposed on the front wall of the display device body 1, the section 2 comprising a plurality of light emitting elements (such as monochromatic cathode ray tubes or colored light emitting tubes) and having a cooling air passage on the rear wall, which is formed by a removable separator 3. Air cooling type air conditioners 4 are provided inside of the display device body 1, and a duct 5 is connected to each air conditioner 4, the duct 5 having air blowing outlets 6 through which cooling air is directed to the cooling air passage. The air conditioners are installed on the internal wall of the display device body 1 and have two openings, namely, an external cooling air inlet 7 and an external air discharging outlet 8. The two openings 7 and 8 are provided with covers 9 which are vertically swingable to close when the large display device is moved or the air conditioners 4 are not in operation.

The large display device thus constructed will now be described in more detail.

The light emitting display section 2 defines a kind of duct, which is the aforementioned cooling air passage, between its rear surface and the separator 3. Cooling air from the air blowing outlet 6 flows along the rear wall of the light emitting display section 2 to effectively cool the latter, and is then introduced to the air conditioners 4 from below the light emitting display section 2.

In FIG. 2, the broken line indicates the flow of cooling air.

Since the separator 3 can be readily removed, inspection or replacement of the light emitting display section 2 can be readily achieved. In each air conditioner 4, the cooling air is introduced thereinto through a lower portion of the rear wall of the air conditioner and is discharged through an upper portion of the rear wall. In the air conditioner 4, the internal circulating air is completely separated from the external air.

As is apparent from the above description, according to the invention, only the internal air is circulated for cooling. Therefore, the internal equipment is not affected by the external air, that is, equipment trouble due to external airborne dust and moisture will not be caused. Covers which can be vertically swung are provided for the external air intake and the external air discharging outlet, and therefore the formation of an external air short-circuiting loop is prevented.

What is claimed is:

1. A large movable display device comprising a hollow display device body, a light emitting section provided on an external surface of said display device body for displaying characters and images, air conditioning means provided inside said display device body for blowing cooling air over the rear surface of said light emitting section for cooling said light emitting section, external air inlet means and external air outlet means located in an external surface of said body adjacent said air conditioning means, cover means provided for said external air inlet means and said external air outlet means for selectively opening and closing said inlet and outlet means to control the flow of external air for cooling said air conditioning means, removable separator panel means disposed in said display device body in spaced relation to said rear surface of said light emitting means to define a cooling passage between said panel means and said light emitting display section and duct means extending from said air conditioning means and having cooling air outlet disposed at the top of said cooling air passage above said separator panel means whereby said cooling air is directed through said duct means and then downwardly through said cooling air passage.

2. A display device as set forth in claim 1 further comprising a return air passage extending from the bottom of said separator panel means between the lower end of said cooling passage and said air conditioning means.

3. A display device as set forth in claim 1 further comprising movable trailer means supporting said display device body.

* * * * *